US005664978A

United States Patent [19]

Howe

[11] Patent Number: 5,664,978

[45] Date of Patent: Sep. 9, 1997

[54] PROPULSION SYSTEM FOR A VEHICLE

[76] Inventor: Edwin W. Howe, 1150 McDonald Pl., Baldwin, N.Y. 11510

[21] Appl. No.: 629,165

[22] Filed: Apr. 8, 1996

[51] Int. Cl.[6] ..... B63H 20/14

[52] U.S. Cl. ..... 440/75; 440/79; 180/6.002

[58] Field of Search ..... 180/6.2, 6.44; 440/74, 75, 79, 80; 475/18, 28, 29; 477/1, 35, 36, 165, 121

[56] References Cited

U.S. PATENT DOCUMENTS

| | | | |
|---|---|---|---|
| 3,112,728 | 12/1963 | Krause | 440/79 |
| 3,601,211 | 8/1971 | Finke | 475/28 |
| 3,602,319 | 8/1971 | Armasow | 180/6.44 |
| 3,922,997 | 12/1975 | Jameson | 440/88 |
| 5,413,512 | 5/1995 | Belenger | 440/74 |

*Primary Examiner*—Edwin L. Swinehart
*Attorney, Agent, or Firm*—Alfred C. Hill

[57] ABSTRACT

A propulsion system for a vehicle having a longitudinal axis comprising a single driving source having a driving shaft; a pair of driven elements, each of the pair of driven elements being spaced from and on opposite sides of the longitudinal axis; a first differential device having an input shaft coupled to the driving shaft and two output shafts; a second differential device having an output shaft coupled to one of the pair of driven elements, a first input shaft coupled to one of the two output shafts of the first differential device and a second input shaft coupled to the driving shaft; a third differential device having an output shaft coupled to the other of the pair of driven elements, a first input shaft coupled to the other of the two output shafts of the first differential device and a second input shaft coupled to the driving shaft; and a control arrangement coupled to the driving source, the first input shaft and the output shaft of the second differential device and the first input shaft and the output shaft of the third differential device to control the relative speed of each of the pair of driven elements to enable controlling the speed and maneuvering of the vehicle.

20 Claims, 5 Drawing Sheets

PROPULSION SYSTEM FOR A VEHICLE

BACKGROUND OF THE INVENTION

The present invention relates to dual propeller drive systems and more particularly a device for converting a single drive shaft to a multi-propeller drive system.

It should be clearly understood that while the present invention is described with respect to a dual propeller drive system for a marine vehicle, the propulsion system of the present invention can be used upon and relates to propulsion systems for land as well as marine vehicles, such as tractors, military tanks and farm tractors having controllable power applied to each of the driven arrangements such as the treads of the land vehicles mentioned hereinabove.

As is well known in the art, dual propeller systems provide for greater maneuverability and for greater directional stability against wind and water currents than do single propeller drive systems. Increased maneuverability and directional stability make navigation through crowded waters easier and facilitates docking of a marine vehicle. Dual propeller drive systems obtain this greater maneuverability and directional stability by individually controlling propeller speed in such a manner as to allow the propellers to rotate at different speeds. The rotating propellers at different speeds enable the marine vehicle to change its course without having to change the position of the propellers or the position of a rudder.

While various conventional arrangements have been developed to obtain the benefit of individually controllable propeller speeds, such arrangements generally suffer from one or more disadvantages. For example, some of these arrangements use a separate engine and transmission system for each propeller. This generally increases the size, weight and expense of the system and requires a corresponding increase in the amount of time and expense required to maintain and operate such system. Other arrangements, such as that disclosed in U.S. Pat. No. 3,112,728, uses a single engine with a separate transmission system for each propeller. However, such dual transmission arrangements suffer from the added size, expense and required maintenance associated with a second transmission system.

A dual propeller drive system using a single transmission is described in U.S. Pat. No. 3,922,997. However, the single transmission system of this patent requires separate gear sets, clutch assemblies and associated control elements for each propeller drive shaft. The use of separate gear sets, clutches and control elements generally increases the size, expense, complexity and/or required maintenance of the propeller drive systems.

None of the above mentioned systems implement a multi-propeller drive system that allows the speed of each propeller to be independently controlled without using relatively expensive and complex equipment, or a separate engine and transmission system for each propeller.

U.S. Pat. No. 5,413,512, discloses a multi-propeller drive system having a single input shaft for connection to an engine system, a differential gear assembly for dividing the driving force from the input drive shaft between a pair of output shafts and a pair of laterally spaced propellers driven by the output shafts of the differential gear assembly. The differential gear assembly operates in a manner wherein one output shaft, if required, is permitted to revolve at a different rate than the other output shaft. A pair of brake mechanisms acting on the output shafts of the differential gear assembly enable an operator to control the rotational speed of the respective propellers without modifying the engine speed or the transmission setting. The control associated with the drive system of this patent enables the control of the rotational speed of the propellers from a zero value to a positive value, but does not enable control of the propeller speed from a zero value to a negative value thereby controlling the direction of rotation of the dual propellers. Also, the arrangement of this prior art patent has a disadvantage due to difficulty in maintaining balance of speeds at the propellers.

The propulsion system of the above mentioned patents with the exception of U.S. Pat. No. 5,413,512 have a number of disadvantages, namely, the space required for a dual engine installation in a marine vehicle; the high operating costs due to the fuel flow requirements associated with two engines; the reduction in fuel tank capacity, and thus operating range, due to overall space limitations; the initial cost and maintenance of dual engines; and the general complication of operating four independent controls (speed and direction of each engine) in order to accomplish the desired maneuvering of the vehicle.

SUMMARY OF THE INVENTION

An object of the present invention is to minimize the above mentioned disadvantages while maintaining the desired control and vehicle maneuverability, primarily based upon the use of a single drive engine in combination with a unique gearing system and electrical control elements.

Another object of the present invention is to provide a dual propeller drive system wherein the speed of each propeller or driven means can be individually controlled.

Still another object of the present invention is to provide a dual propeller or driven means drive system wherein the speed of each propeller or driven means can be individually controlled and maintained, thus allowing the propellers to rotate at the same or different speeds without requiring relatively expensive, sizeable and/or complex equipment.

A further object of the present invention is to provide a dual driven means drive system wherein each driven means can operate at the same or different speeds without requiring separate engines and/or transmission systems for each driven means.

Still a further object of the present invention is to provide a dual driven means drive system wherein each driven means may be controlled to provide a control of driven means speed and direction of movement.

Still another object of the present invention is to provide a control system for a vehicle propulsion system having dual driven means which enables controlling the speed of each of the driven means from a predetermined negative value to a predetermined positive value thereby enabling the electrical control system to reverse the relative movement of the driven means.

A feature of the present invention is the provision of a propulsion system for a vehicle having a longitudinal axis comprising a single driving source having a driving shaft; a pair of driven means, each of the pair of driven means being spaced from and on opposite sides of the longitudinal axis; a first differential means having an input shaft coupled to the driving shaft and two output shafts; a second differential means having an output shaft coupled to one of the pair of driven means, a first input shaft coupled to one of the two output shafts of the first differential means and a second input shaft coupled to the driving shaft; a third differential means having an output shaft coupled to the other of the pair of driven means, a first input shaft coupled to the other of the two output shafts of the first differential means and a second input shaft coupled to the driving shaft; and a control means coupled to the driving source, the first input shaft and the output shaft of the second differential means and the first input shaft and the output shaft of the third differential means to control the relative speed of each of the pair of driven means to enable controlling the speed of and maneuvering of the vehicle.

The basic concept of the present invention is the use of a system of differential gearing devices which interconnect the drive engine to the two propellers, or driven means. Mechanical differentials are best represented by the device which connects the two rear wheels of a car to the engine. In addition to providing the basic interconnection and drive means, a significant function of the differential is to permit independent rotation of the two wheels as would be experienced during the turning of the car, whereby the two wheels must rotate at a different rate of speed. This feature of a differential can also result in a condition of the full engine drive effect being applied to a single wheel if one wheel is subjected to a significantly higher amount of resistance to motion than the other wheel.

It is this characteristic of the differential which is utilized to control the relative speed of the two propellers in accordance with the principles of the present invention. For example, if the drive load or friction of the two propellers shafts are equal, then their rotational speeds would be the same, and basically equal to the input to the differential. However, if it is desired that one propeller shaft rotate at a higher rate than the other, then an additional amount of friction may be added to the higher speed shaft, such as a drag brake device, thus resulting in a reduced speed of this shaft and a corresponding increase in the speed of the other shaft.

In order to permit the control of the difference in the two speeds, it is proposed to incorporate speed sensing elements on each propeller shafts in combination with an electrical control system. This control system would compare the two speeds, plus an external signal which would represent the desired difference in the two signals. The output of this control system would then be applied to two drag brakes, one associated with each propeller drive shaft. If a zero speed difference is desired between the two shafts, then the electrical control system would automatically maintain a balanced friction load on each shaft. If a speed difference is desired, as represented by the external command signal, then the resulting imbalance in the control system would apply the necessary drag friction to the appropriate drive shaft in order to achieve the required speed difference.

The above indicated concept is sufficient if the speed control range is only required to vary from zero to a maximum, with the direction of rotation being determined by the selection of forward or reverse by a transmission unit associated with the drive engine. In order to provide the desired range of maneuvering, it is necessary to permit the reversing of one propellers direction of rotation relative to the other. For this purpose, two additional differential devices are incorporated in the drive system between the output of the first differential and each of the two propeller shafts. These units utilize the functional characteristics of differentials to add or subtract rotational inputs. For this purpose the direct output of the drive engine is applied to the second and third differentials along with the outputs of the first differential. As a result, the final output speed of the propeller shaft can be caused to rotate in the reverse direction when the output of the first differential is brake to a zero speed condition. Under this condition, the opposite propeller shaft will also experience the combined effect of a higher speed output from the first differential plus the effect of the direct input from the drive engine. The net result is that this shaft will rotate at three times the rate, but in opposite direction as the other shaft, thus resulting in a significant maneuvering effect of the marine vehicle.

An additional feature of the present invention is to provide an arrangement such as a "joy stick" whose direction of motion will result in a corresponding direction of motion of the vehicle as determined by the relative speed of the two drive means, thereby increasing the maneuvering effect of the vehicle.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
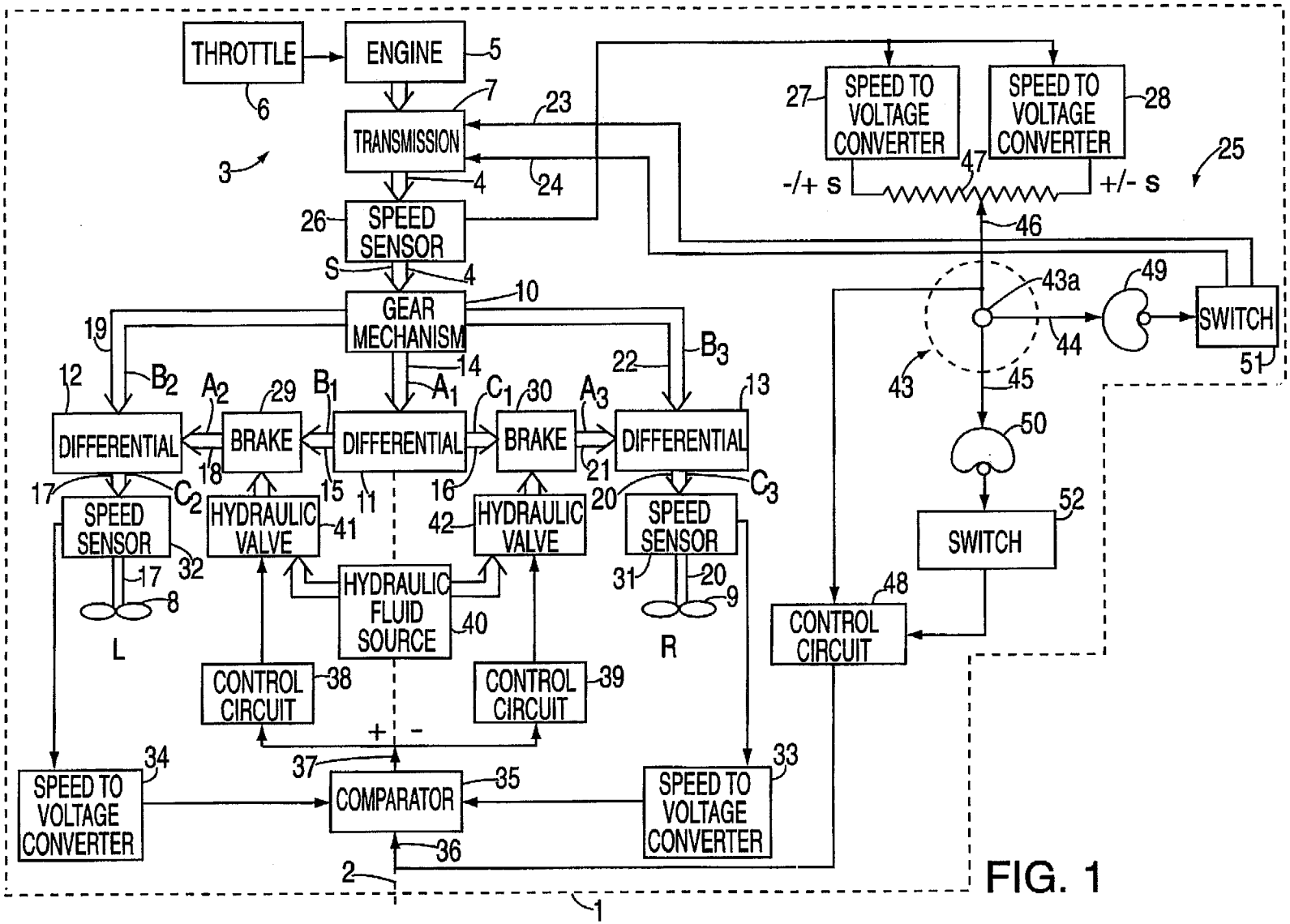
FIG. 1 is block diagram of the propulsion system in accordance with the principles of the present invention enabling the control of the final speed and rotation of the pair of propellers for a marine vehicle, or a driven means for a land vehicle.

Referring to FIG. 1, the propulsion system for a vehicle 1 having a longitudinal axis 2 is illustrated as including a single driving source 3 having a driving shaft 4. The source 3 includes an engine 5 whose speed is controlled by a conventional throttle 6. The output of engine 5 is coupled to a transmission 7 which controls the direction of rotation of the driving shaft 4.

A pair of driven means 8 and 9, illustrated to be propellers, are each spaced from the longitudinal axis 2 and on opposite sides thereof. Preferably, the driven means 8 and 9 would be equally spaced from longitudinal axis 2, but this is not a necessary requirement in the maneuvering of a vehicle whether it is a marine or a land vehicle. Driving shaft 4 is connected from transmission 7 to gear mechanism 10. The driving speed is then transferred from gear mechanism 10 to the first differential 11, the second differential 12 and the third differential 13. Differential 11 has an input shaft 14 and two output shafts 15 and 16. Second differential 12 has an output shaft 17 connected to driven means, or propeller, 8 and two input shafts with one of the input shafts 18 being coupled to the output shaft 15 of differential 11 and the other input shaft 19 being coupled to an output of gear mechanism 10 to receive the rotational speed from the driving source 3. Differential 13 has an output shaft 20 coupled to the driven means, or propeller, 9 and two input shafts, namely, shaft 21 coupled to the output shaft 16 of differential 11 and shaft 22 coupled to the output of gear mechanism 10 to receive the input from the driving source 3.

The interconnection of these various elements utilize standard mechanical drive elements and related supporting structures which are well known to those versed in the design of basic mechanical devices. The differentials 11, 12 and 13 are likewise standard devices such as utilized in the wheel drive system of automotive vehicles. The function of these devices are also well known, but for the purpose of this particular application the designations A, B and C represent the basic inputs and outputs of the differential units with the subscripts 1, 2, and 3 associated with the individual units. The relationship between these inputs and outputs are expressed as follows:

$$2A=B+C \quad (1)$$

Based upon the formula (1), in the commonality of the various inputs and outputs, the following overall relationship between the output speed and the left (L) and right (R) rotational speed of the propellers 8 and 9 results as follows:

$$L=2B_1-S \quad (2)$$

$$R=2C_1-S \quad (3)$$

Where $B_1$ can vary from the value of S to 0 to 2 S and $C_1$ can vary from a value of S to 2 S to 0.

Based upon equations (2) and (3) the rotational speeds of the propellers 8 and 9 can, therefore, vary from −S to +S to +3 S. The means of accomplishing this range of control is described with reference to FIG. 1 as follows. In FIG. 1, the basic source of drive power is engine 5 with an output transmission 7. The operating speed of the engine is varied by a separate control, such as throttle 6, while the selection of forward or reverse of shaft 4 is provided by transmission 7. Thus, the plus sign or minus sign direction of the output shaft 4 is determined by the input commands 23 and 24 from control means 25. For use in the control system 25, the magnitude of the operating speed is coupled from speed sensor 26 to the speed to voltage converters 27 and 28.

Brake 29 is associated with the output shaft 15 of differential 11 and brake 30 is associated with the output shaft 16 of differential 11. The function of brakes 29 and 30 will be explained later. Although shown to be hydraulic, brakes 29 and 30 could be electric or pneumatic brake systems.

Electrical speed sensing element 31 is coupled to the output of the propeller drive shaft 20 and the speed sensor 32 is coupled to the propeller drive shaft 17. Speed sensors 26, 31 and 32 are standard commercially available devices. The outputs from speed sensors 31 and 32 are applied to the speed to voltage converters 33 and respectively which convert the speed from sensors 31 and 32 to + and − polarity voltage signals. These signals are applied to the comparator 35 which determines the difference between these two signals. The purpose of the other input signal at 36 will be explained later.

The output signal 37 from comparator 35 which represents the difference between the operating speeds of propellers 8 and 9. Based upon the inherent characteristics of the first differential 11 and the relationships expressed in equations (1), (2) and (3) above, the difference in propeller speeds will be determined by the relative output speeds of differential 11. As represented by the action of the differential associated with the two drive wheels of an automobile, the primary factor in determining the balance speed of the two wheels is the relative drive load or resistance applied to the two outputs of the differential. In this application, it is intended to provide the means for varying the magnitude of the drive load on the two outputs of differential 11, and thus, the relative speeds of these two outputs and, thereby, the final speeds of the propeller shafts 17 and 20. This is accomplished by applying signal 37 through electrical control devices 38 and 39 to eventually determine the loads on differential 11. In the preferred form, this may be accomplished by utilizing mechanical braking devices 29 and 30 which are similar to standard automobile brakes of the disc brake type. In order for brakes 29 and 30 to function, a source of hydraulic fluid, such as source 40, is required. A means of varying the amount of pressure to the individual brakes 29 and 30 is required, such as electrically controlled valves 41 and 42 of the standard commercial type. The signal at the output of circuits 38 and 39 control the amount of fluid pressure applied to brakes 29 and 30 through valves 41 and 42. The function of the speed control system may now be apparent by considering the effect of signal 37. If the two outputs from converters 33 and 34 are equal, then the difference signal 37 is zero, and no command is applied to the circuits 38 and 39. If there is a difference in the speed related voltage signals from converters 33 and 34, a corresponding difference voltage at 37 will result whose + or − polarity will depend upon which speed related voltage signal is greater. Based upon the magnitude and polarity of signal 37, a signal will be applied to the appropriate brake channel on one output of differential 11. This braking effect will then result in a change in the relative speed of the two outputs of the differential 11, and a corresponding change in the final speed of the propeller shafts 17 and 20. Based upon this feedback control system, an appropriate drag torque braking effect will then be established on the outputs of the differential 11 as required to maintain equal propeller drive shaft speeds. The means of creating such a control system is well within the capability of those versed in conventional electric design concepts and related technologies.

The ability to control the desired difference in propeller output speed may now be explained with reference to the remaining portion of the circuit elements of control means 25. In accordance with the principles of the present invention it is intended to use a joy stick-type control device as a source of the signals which determine the relative speed and directional rotation of the propeller shafts 17 and 20. As illustrated in FIG. 1, the joy stick device 43 provides for two axis of motion which results in outputs 44 and 45 which are at right angles to each other. Motion of the joy stick 43*a* about a nominally horizontal (right-left) direction is primarily utilized to position a pick off sensing element 46 on an electrical resistive device 47, such as a potentiometer. As illustrated, the potentiometer 47 is energized with a voltage at each end which is provided by the speed to voltage converters 27 and 28. These voltages are + and − polarity representations of the basic output speed of sensor 26. As a result of equal + and − speed voltages being applied to potentiometer 47, a net zero voltage will result at the center position.

In order to utilize joy stick 43*a* to control the final speed difference of propeller shafts 17 and 20, the output signal from the potentiometer 47 is applied to comparator 35 as signal 36 through control circuit 48. As previously described, the function of comparator 35 is to maintain equality of the two basic speed related voltage signals from converters 33 and 34 by means of appropriate braking on the outputs 15 and 16 of differential 11 through brakes 29 and 30. However, if a voltage from circuit 48 is applied to the comparator 35, the initial result of this voltage will be to cause a corresponding output 37 which will cause an increase in braking effect on one output shaft 15 or 16 of differential 11. This braking effect will then result in a change in the relative speed of the propeller shafts 17 and 20 and, thus, the voltages at the outputs of converters 33 and 34. Based upon prior proper polarities (phasing) and scaling of the varying signals, the resulting difference in the speed signals will correspond to the magnitude of the command signal 36 from joy stick device 43*a*. This condition will then be maintained by a fixed unbalanced braking effect on differential 11 by brakes 29 and 30. It is therefore apparent that the magnitude of the desired speed difference can be determined by the horizontal position of joy stick 43*a*. In addition, the sense of this speed difference (which is determined by whether the right or left propeller is rotating faster then the other) is also a function of the + or − polarity of the signal 36 as determined by the left or right position of joy stick 43*a*.

Additional elements of the control means 25 include the cams 49 and 50 which are utilized to activate, respectively, electrical switches 51 and 52. The function of cams 49 and 50 and switches 51 and 52 is to consider certain practical operating conditions. For example, it is a typical requirement to maintain an equal operating speed for the two propellers 8 and 9 under normal forward or reverse speed conditions. This condition will correspond to a zero voltage for signal 36 from control means 25. As an alternative to maintaining a precise center or zero voltage condition of potentiometer 47, cam 50 and switch 52 will be utilized to maintain the signal 36 at a zero value (shorted to ground) over an angular range of control of approximately + or −5 degrees, or any other predetermined value. This zero voltage is applied to control circuit 48 and in order to create this condition over the desired angular range circuit 48 will not be activated to provide other control voltages until switch 52 is activated by cam 50. Cam 49 is positioned to respond to the forward-reverse motion of joy stick 43*a*. Its purpose is to activate switch 51 beyond an angular range of approximately + or −5 degrees. When joy stick 43*a* is positioned in the forward direction beyond the 5 degree value, the switch 51 provides a signal 23 to the engine transmission 7 resulting in a forward direction of rotation of shaft 4. When the joy stick 43*a* is positioned to the reverse position, switch 51 provides signal 24 to transmission 7 resulting in a reverse direction of rotation of shaft 4. The function of this directional control capability will be apparent as a result of the following discussion related to the effect of the various control signals and relative propeller speeds on the resulting maneuvering effect of the vessel.

Figure 2:
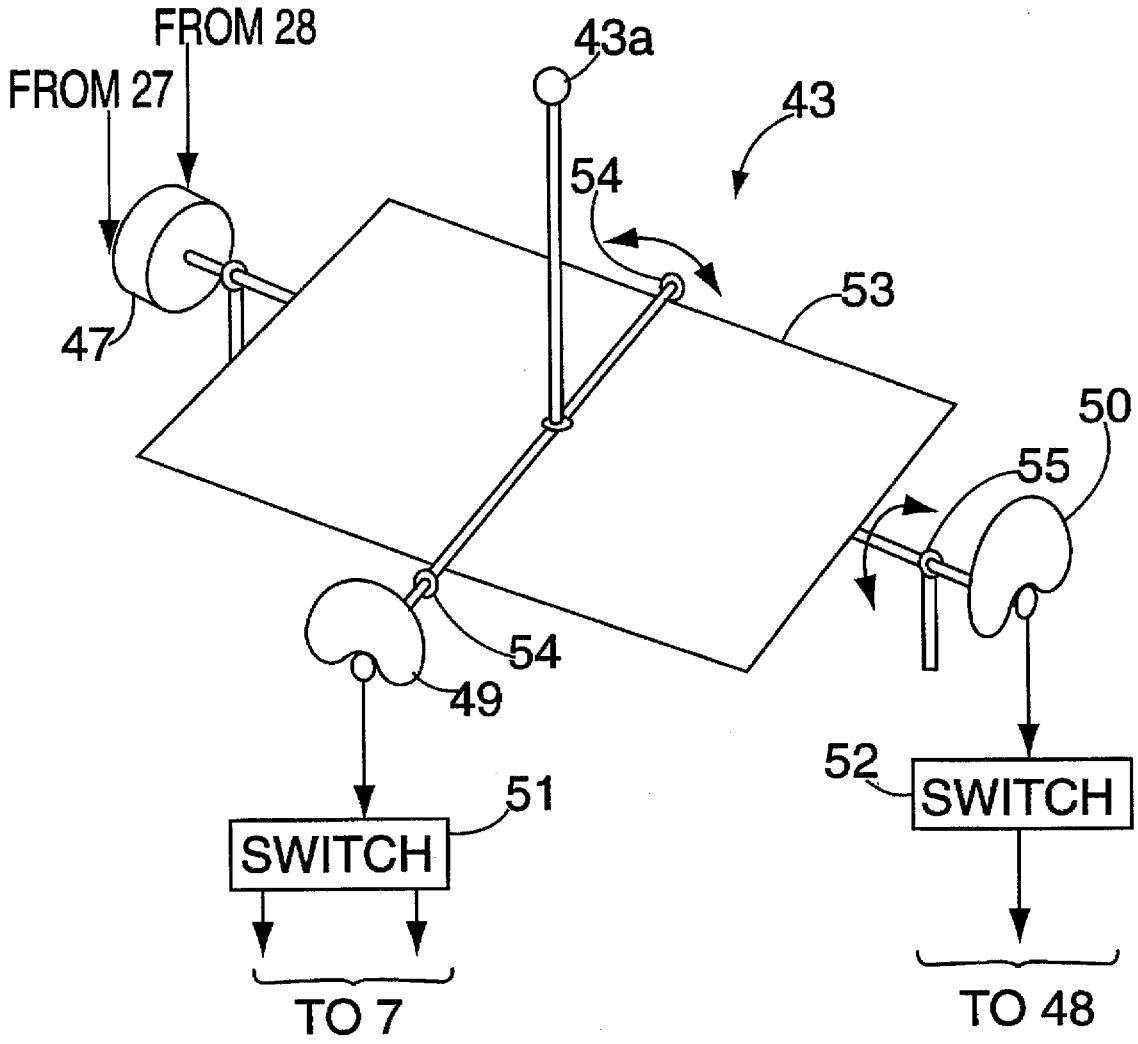
FIG. 2 is a sketch indicating the configuration of the "joy stick" control which determines the relative speed of the two propeller shafts, or driven means, and the resulting direction of rotation of these devices.

Referring to FIG. 2, there is illustrated therein the basic design features of the directional control joy stick device 43 of FIG. 1. The purpose of the joy stick device 43 is to permit the operator to determine the direction of motion of the vessel by a natural intuitive motion of the joy stick 43*a*. In its preferred configuration, a centrally located control handle or joy stick 43*a* is supported on an intermediate frame 53 which permits angular motion in an normally forward-reverse direction about pivots 54. Associated with this motion is cam 49 which interacts with electrical switch 51. The operation of these devices have been previously described. The remaining function of the joy stick device 43 is to provide an angular motion of frame 53 relative to a fixed support 55 and a rotary electrical potentiometer 47. A cam-like device 50 and switch 48 are also provided on this support axis. The angular motion about this axis permits nominally right-left motion of the joy stick 43*a*. The effect of this arrangement of elements is to permit essentially universal motion of the joy stick 43*a* in any direction, which will result in a corresponding motion of the vessel.

Figure 3:
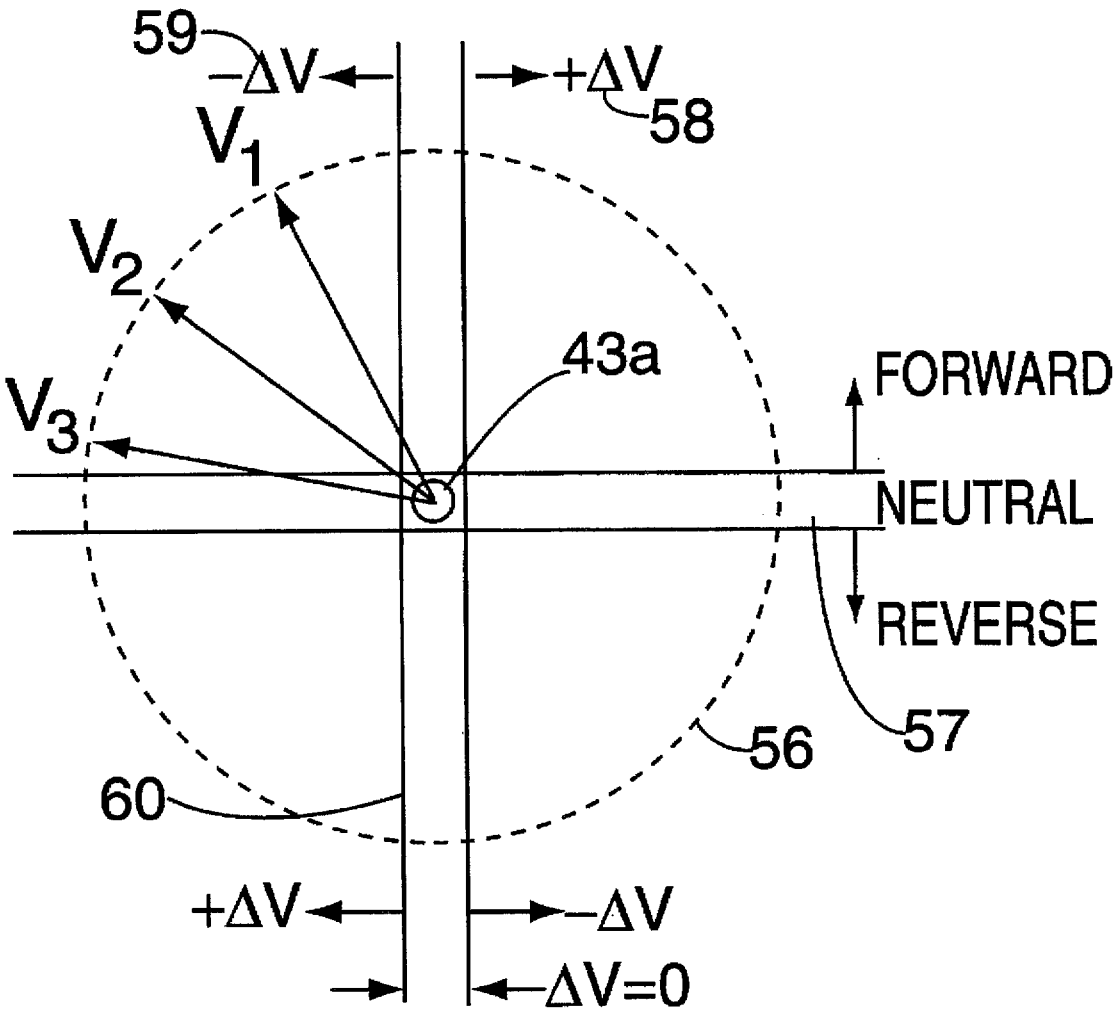
FIG. 3 is a vector diagram which represents the signals provided by the "joy stick" control device of FIG. 2.

Referring to FIG. 3, there is illustrated therein the resulting control signals which are provided by the motion of the joy stick 43*a*. The central joy stick 43*a* is basically limited to a circular range of motion 56 by means of the support housing for this device as shown in FIG. 2. As a natural representation of the desired motion of the boat, the forward direction of the joy stick 43*a* will result in a corresponding motion of the vessel. Likewise, the motion of the joy stick 43*a* in the reverse direction will cause an equivalent motion of the vessel. An additional feature of this control arrangement will permit the selection of a neutral (neither forward or reverse) operating condition of the engine transmission, which as may be desired during starting the engine or under certain maneuvering conditions. For this purpose a dead zone 57 is provided by the action of cams 50 and 52 as described hereinabove. This condition can also be established by a finite "feel" in the joy stick 43*a*.

The primary function of the horizontal or left-right motion of joy stick 43*a* is to provide an appropriate signal 58 or 59 to comparator 35 which represents the desired direction of motion of the vessel. This signal is represented by the various control positions in FIG. 3 which will result in typical command voltages $V_1$, $V_2$, $V_3$. It is these voltages which are supplied to comparator 35 as described hereinabove with respect to FIG. 1. Also note that these voltages are essentially proportional to the angular position of the joy stick 43*a* plus the magnitude of the engine speed S as shown in FIG. 1. The effect of these voltages and associated propeller speeds on the maneuvering of the vessel will be described later with reference to FIGS. 4–11. The remaining function of this control in the horizontal direction is the limited position range in the center position 60 which overrides the proportional speed control signal to assure a zero operating propeller speed difference in this center range.

The final feature of the present invention relates to the effect of the different propeller speeds, as determined by the above described control circuitry, upon maneuvering of the vessel. The basis for this discussion are the following expressions which summarize the effect of the speed difference of the propellers ΔV, and the relative speeds of the left $B_1$ and right $C_1$ outputs of differential 11 of FIG. 1. As previously described, relative speeds of these differential outputs are controlled by the braking effect of the control system as a result of the desired ΔV command signal. These relationships are expressed as follows:

$$2\,S=B_1+C_1, \tag{4}$$

where S=engine speed as determined by throttle 6

For Forward Engine Speed $$L=2\,B_1-S, \tag{5}$$

where L=speed of left propeller $$R=2\,C_1-S, \tag{6}$$

where R=speed of left propeller

For Reverse Engine Speed (S=−S)

$$L=S-2\,B_1 \tag{7}$$

$$R=S-2\,C_1 \tag{8}$$

$$\Delta V=L-R \tag{9}$$

Based upon the braking effects of the control system on outputs $B_1$ and $C_1$ of the differential 11, which can range from zero to full stop, in the expression (4), the magnitude of these functions L and R can vary from −S to +S and +3 S to −3 S. This range of control and resulting propeller effect upon the vessels motion are apparent with reference to FIGS. 4–11.

Figure 4:
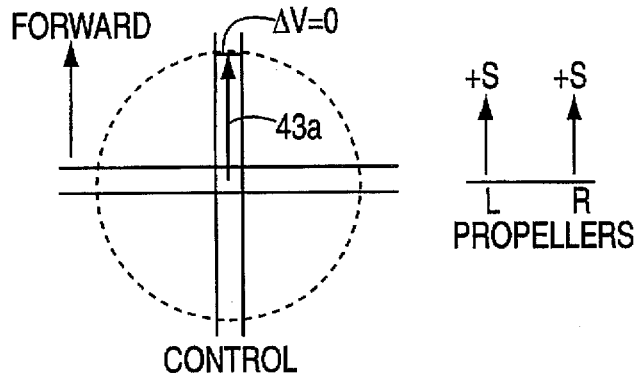
FIGS. 4–11 are vector diagrams illustrating various relationships between the propeller speed and the "joy stick" command signals due to its position and the resulting motion of the marine vehicle, or a land vehicle.
Figure 5:
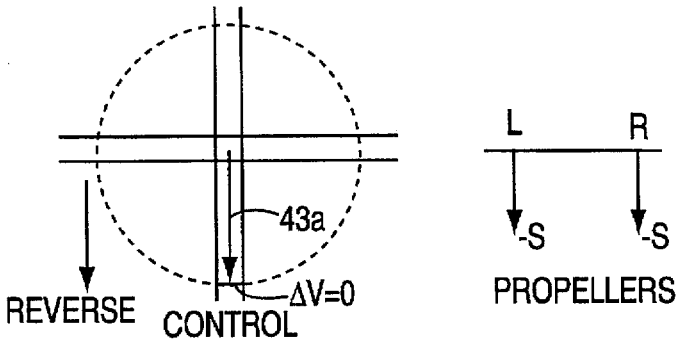
Figure 6:
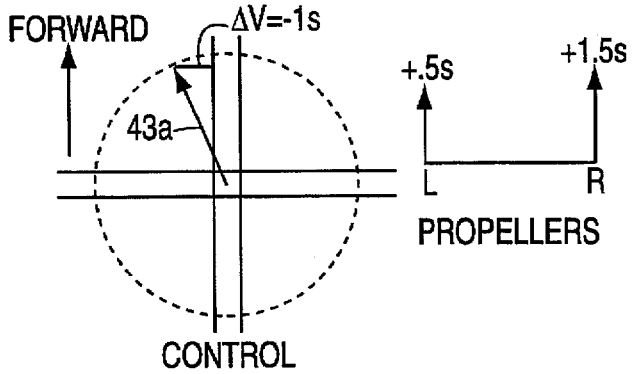

The objective of FIGS. 4–11 is to represent the effect of the speed control signal ΔV which corresponds to the joy stick 43*a* position (direction). As indicated in FIG. 4, if the joy stick 43*a* is positioned in a center forward direction, this results in ΔV=0 and a forward speed command to the transmission 7. In accordance with equation (4) above $B_1+C_1$ will then be equal and with a value of S. In accordance with equations (5) and (6) above, L and R propeller speeds will then be equal to the values of S and in the forward direction. FIG. 5 indicates the effect of the joy stick 43*a* in a reverse center position. In accordance with equations (7) and (8) above, L and R speeds are then equal in value to −S, resulting in a normal reverse motion of the vessel. Referring to FIG. 6, the effect of the joy stick 43*a* being position to the left-forward position results in the transmission being commanded to a forward speed condition and the ΔV signal will be in the minus direction with a value of approximately −1 S. The indicated expressions result in values of left L and right R propeller speeds of +0.5 S and +1.5 S, respectively. As a result of this difference in propeller thrust effect, it is apparent that the vessel will travel in a forward direction, but due to the higher thrust on the right side, the boat will have a net turning effect to the left. This motion will generally represent the same direction as the position of the joy stick 43*a*.

Figure 7:
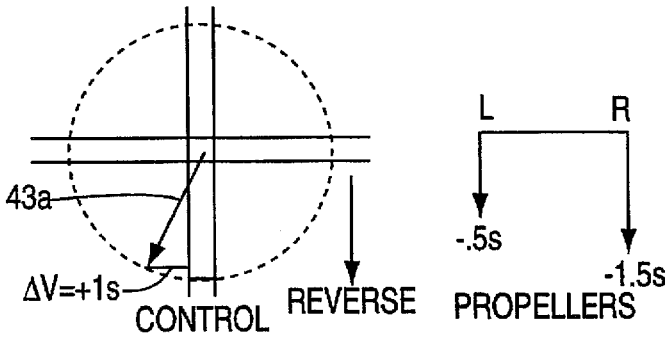

In a similar manner, FIG. 7 indicates the joy stick 43*a* position in the lower left direction. The resulting effects are based upon a reverse command to the transmission 7 and a ΔV value of +1 S. Note that this reversal of speed signal polarity is automatically determined due to the reverse speed direction signal, and results in the proper effect upon the control system and related expressions. Based upon the indicated control signals the appropriate left and right propeller speeds of −0.5 S and −1.5 S results, with a corresponding motion of the boat in the reverse direction with a turning effect to the left.

Figure 8:
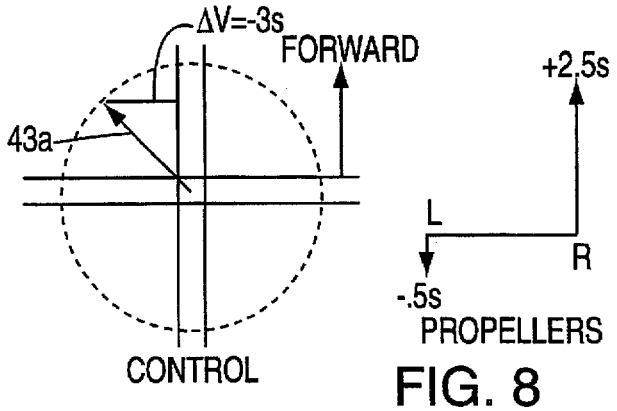

Referring to FIG. 8, the effect of the joy stick 43*a* in a more left forward position, such that the ΔV signal is equal to −3 S. The left and right propeller speeds will then be −0.5 S and +2.5 S, respectively, as a result the left side of the vessel will tend to go in the reverse direction, while the right side will go forward at a relatively high speed. The resulting maneuvering effect will then be a sharp turn to the left with some forward motion which corresponds to the position of joy stick 43*a*.

Figure 9:
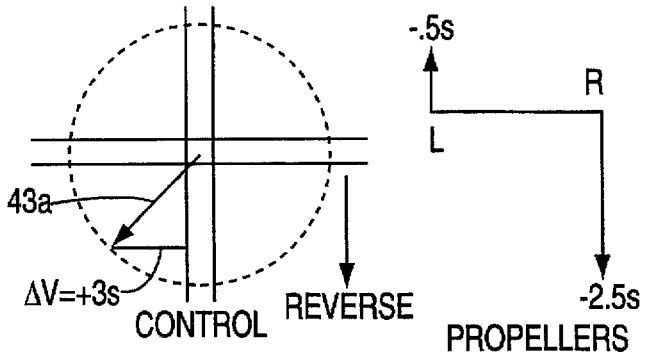
Figure 10:
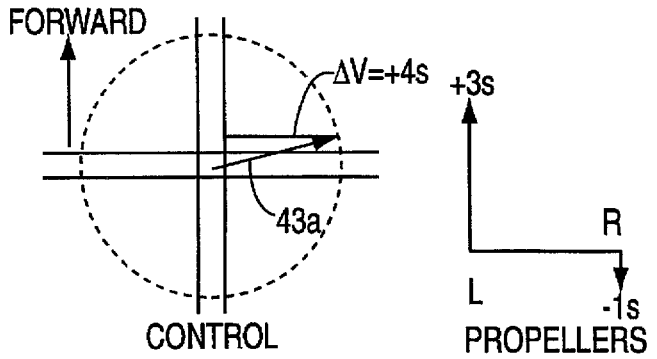
Figure 11:
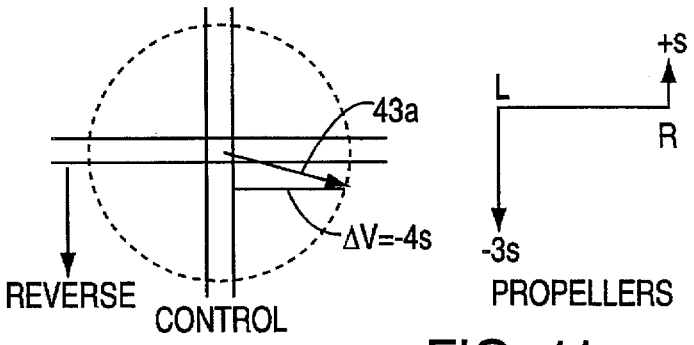

FIGS. 9, 10, and 11 represent the effects of various positions of joy stick 43*a* and the resulting motion of the vessel. Based upon these examples, it is apparent that the desired maneuvering of the boat will generally result from a corresponding position of the joy stick 43*a*. The actual correspondence will depend upon many variables related to a particular installation and various vessel characteristics.

While I have described above the principles of my invention in connection with specific apparatus, it is to be clearly understood that this description is made only by way of example and not as a limitation to the scope of my invention as set forth in the objects thereof and in the accompanying claims.

I claim:

1. A propulsion system for a vehicle having a longitudinal axis comprising:

a single driving source having a driving shaft;

a pair of driven means, each of said pair of driven means being spaced from and on opposite sides of said longitudinal axis;

a first differential means having an input shaft coupled to said driving shaft and two output shafts;

a second differential means having an output shaft coupled to one of said pair of driven means, a first input shaft coupled to one of said two output shafts of said first differential means and a second input shaft coupled to said driven shaft;

a third differential means having an output shaft coupled to the other of said pair of driven means, a first input shaft coupled to the other of said two output shafts of said first differential means and a second input shaft coupled to said driving shaft; and a control means coupled to said driving source, said first input shaft and said output shaft of said second differential means and said first input shaft and said output shaft of said third differential means to control the relative speed of each of said pair of driven means to enable controlling the speed of and maneuvering of said vehicle.

2. A system according to claim 1, wherein said control means includes a first brake means coupled to said first input shaft of said second differential means;

a second brake means coupled to said first input shaft of said third differential means;

a first speed sensor means coupled to said output shaft of said second differential means providing a first output signal proportional to the speed of said one of said pair of driven means;

a second speed sensor means coupled to said output shaft of said third differential means providing a second output signal proportional to the speed of said other of said pair of driven means, and a comparator means coupled to said first and second speed sensor means responsive to said first and second output signals to produce a speed control signal indicating a difference between the speed of said pair of driven means, said speed control signal being coupled to said first and second brake means to control the speed of each of said pair of driven means.

3. A system according to claim 2, wherein said control means further includes a third speed sensor means coupled to said driving shaft providing a third output signal proportional to the speed of said driving source;

a single lever means whose position determines the maneuvers of said vehicle; and an electric circuit means coupled to said third speed sensor means and said single lever means to provide a fourth output signal coupled to said driving source to control the direction of rotation of said driving shaft and a fifth output signal coupled to said comparator means to further refine said speed control signal to enable control of the speed of and maneuvering of said vehicle by said single lever means.

4. A system according to claim 3, wherein said single lever means is a joy stick device.

5. A system according to claim 4, wherein said electric circuit means includes a potentiometer device having a movable arm controlled by said joy stick device.

6. A system according to claim 5, wherein
said driving source includes
an adjustable speed engine, and
a transmission means coupled between said driving shaft and said engine and to said electric circuit means to enable control of the direction of rotation of said driving shaft by said fourth output signal.

7. A system according to claim 6, wherein
said first and second brake means each include
a braking element for an associated one of said first input shafts of said second and third differential means,
a source of hydraulic fluid,
a hydraulic valve coupled to said source of hydraulic fluid, said braking element and said comparator means responsive to said refined speed control signal to control rotation of an associated one of said pair of driven means.

8. A system according to claim 3, wherein
said driving source includes
an adjustable speed engine, and
a transmission means coupled between said engine and said driving shaft and to said electric circuit means to enable said fourth output signal to control the direction of rotation of said driving shaft.

9. A system according to claim 3, wherein
said electric circuit means includes
a switch means coupled to said single lever means to provide a neutral position for said single lever means and said fourth and fifth output signals.

10. A system according to claim 1, wherein
said driving source includes
an adjustable speed engine, and
a transmission means coupled between said engine and said driving shaft and to said control means to enable said control means to control the direction of rotation of said driving shaft.

11. A system according to claim 1, wherein
said control means controls the speed of each of said pair of driven means from a predetermined positive value to a predetermined negative value.

12. A system according to claim 11, wherein
said control means includes
a first brake means coupled to said first input shaft of said second differential means;
a second brake means coupled to said first input shaft of said third differential means;
a first speed sensor means coupled to said output shaft of said second differential means providing a first output signal proportional to the speed of said one of said pair of driven means,
a second speed sensor means coupled to said output shaft of said third differential means providing a second output signal proportional to the speed of said other of said pair of driven means, and
a comparator means coupled to said first and second speed sensor means responsive to said first and second output signals to produce a speed control signal indicating a difference between the speed of said pair of driven means, said speed control signal being coupled to said first and second brake means to control the speed of each of said pair of driven means.

13. A system according to claim 12, wherein
said control means further includes
a third speed sensor means coupled to said driving shaft providing a third output signal proportional to the speed of said driving source;
a single lever means whose position determines the maneuvers of said vehicle; and
an electric circuit means coupled to said third speed sensor means and said single lever means to provide a fourth output signal coupled to said driving source to control the direction of rotation of said driving shaft and a fifth output signal coupled to said comparator means to further refine said speed control signal to enable control of the speed of and maneuvering of said vehicle by said single lever means.

14. A system according to claim 13, wherein
said single lever means is joy stick device.

15. A system according to claim 14, wherein
said electric circuit means includes
a potentiometer device having a movable arm controlled by said joy stick device.

16. A system according to claim 15, wherein
said driving source includes
an adjustable speed engine, and
a transmission means coupled between said driving shaft and said engine and to said electric circuit means to enable control of the direction of rotation of said driving shaft by said fourth output signal.

17. A system according to claim 16, wherein
said first and second brake means each include
a braking element for an associated one of said first input shafts of said second and third differential means,
a source of hydraulic fluid,
a hydraulic valve coupled to said source of hydraulic fluid, said braking element and said comparator means responsive to said refined speed control signal to control rotation of an associated one of said pair of driven means.

18. A system according to claim 13, wherein
said driving source includes
an adjustable speed engine, and
a transmission means coupled between said engine and said driving shaft and to said electric circuit means to enable said fourth output signal to control the direction of rotation of said driving shaft.

19. A system according to claim 13, wherein
said electric circuit means includes
a switch means coupled to said single lever means to provide a neutral position for said single lever means and said fourth and fifth output signals.

20. A system according to claim 11, wherein
said driving source includes
an adjustable speed engine, and
a transmission means coupled between said engine and said driving shaft and to said control means to enable said control means to control the direction of rotation of said driving shaft.

* * * * *